US007681827B2

(12) United States Patent
Chiu et al.

(10) Patent No.: US 7,681,827 B2
(45) Date of Patent: Mar. 23, 2010

(54) LINE-ARRANGING MECHANISM

(75) Inventors: Chia-Hsiang Chiu, Taipei (TW); Wei-Chueh Liao, Taipei (TW); Chun-Hung Chu, Taipei County (TW); Fu-Ping Lin, Taichung (TW)

(73) Assignee: Lite-On Technology Corporation, Taipei (TW)

( * ) Notice: Subject to any disclaimer, the term of this patent is extended or adjusted under 35 U.S.C. 154(b) by 978 days.

(21) Appl. No.: 11/437,347

(22) Filed: May 19, 2006

(65) Prior Publication Data

US 2007/0069061 A1 Mar. 29, 2007

(30) Foreign Application Priority Data

Sep. 29, 2005 (TW) ..... 94133960 A

(51) Int. Cl.
*B65H 27/00* (2006.01)

(52) U.S. Cl. ..... 242/397.2; 242/397.3; 242/482.8

(58) Field of Classification Search ..... 242/397, 242/397.2–397.3, 273, 482.8
See application file for complete search history.

(56) References Cited

U.S. PATENT DOCUMENTS

| | | | | | |
|---|---|---|---|---|---|
| 695,645 | A * | 3/1902 | Morse | 242/477 |
| 848,702 | A * | 4/1907 | Stott | 242/482.8 |
| 2,471,654 | A * | 5/1949 | Reitz | 74/567 |
| 2,599,423 | A * | 6/1952 | Ziegler | 242/390.8 |
| 3,980,252 | A * | 9/1976 | Tae | 242/397.3 |
| 4,334,670 | A * | 6/1982 | Kawabe | 254/346 |
| 4,616,791 | A * | 10/1986 | Harvey | 242/390.6 |
| 5,765,782 | A * | 6/1998 | De Vettor | 242/403 |
| 6,443,431 | B1 * | 9/2002 | Stasny et al. | 254/385 |

* cited by examiner

*Primary Examiner*—Sang Kim
(74) *Attorney, Agent, or Firm*—Quintero Law Office

(57) ABSTRACT

An arranging-line mechanism comprises a cam, an axle connecting to the cam, a sliding element and a transmitting mechanism to drive the cam and the axle. The cam comprises an inclined surface and the sliding element to slide thereon. When the axle revolves, the transmitting mechanism drives the cam to revolve. A power line is wound regularly via the sliding element to slide on the inclined surface.

11 Claims, 6 Drawing Sheets

LINE-ARRANGING MECHANISM

BACKGROUND OF THE INVENTION

1. Field of the Invention

The present invention relates to a line-arranging mechanism.

2. Description of the Related Art

One type of a line-arranging mechanism is applied to a fishing pole. Because the diameter of fishing line is very fine, regularity in the arrangement thereof does not affect the volume of the line-arranging mechanism. Another type of line-arranging mechanism is applied to household appliances. The regularity in the arrangement of a power line of a household appliance is of little concern. Referring to FIG. 1, a conventional line-arranging mechanism 10 demands that the power line be arranged regularly, thus, the conventional line-arranging mechanism 10 comprises a motor 11 to drive a reciprocator for arranging the power line. The conventional line-arranging mechanism 10 comprises a motor 11, a lead screw 12, a reciprocator 14 and a bearing (not shown). The motor drives the lead screw 12 and the reciprocator 14 for regularly arranging the power line.

The conventional line-arranging mechanism 10 is complex and large, thus, the conventional line-arranging mechanism 10 is expensive. The volume of an electronic device has gradually decreased. If the line-arranging mechanism 10 is applied to an electronic device, the volume and cost are increased.

BRIEF SUMMARY OF INVENTION

A detailed description is given in the following embodiments with reference to the accompanying drawings. A line-arranging mechanism comprises a cam, an axle connecting to the cam, a sliding element and a transmitting mechanism to drive the cam and the axle. The cam comprises an inclined surface and the sliding element to slide thereon.

The transmitting mechanism comprises a sun gear, a planet pinion and a ring gear. The sun gear is connected to the axle. The planet pinion engages the sun gear and the ring gear. The ring gear is connected to the cam.

BRIEF DESCRIPTION OF DRAWINGS

The present invention can be more fully understood by reading the subsequent detailed description and examples with references made to the accompanying drawings, wherein.

DETAILED DESCRIPTION OF INVENTION

The following description is a best-contemplated mode of carrying out the invention. This description is made for the purpose of illustrating the general principles of the invention and should not be taken in a limiting sense. The scope of the invention is best determined by reference to the appended claims.

Figure 1:
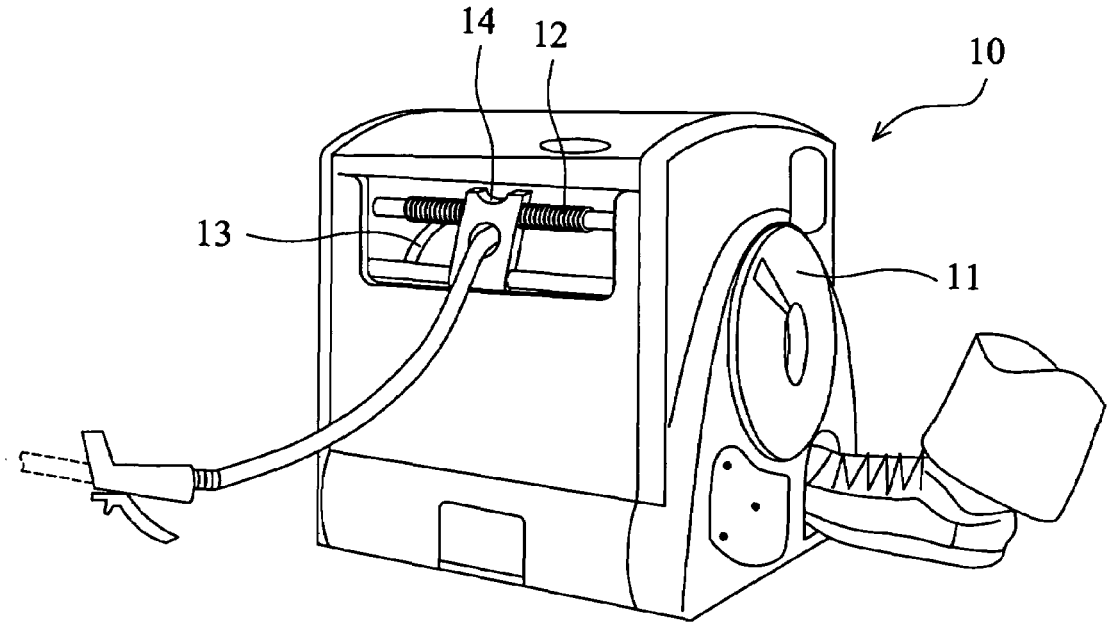
FIG. 1 ( RELATED ART )
FIG. 1 is a schematic view of a conventional line-arranging mechanism.
Figure 2:
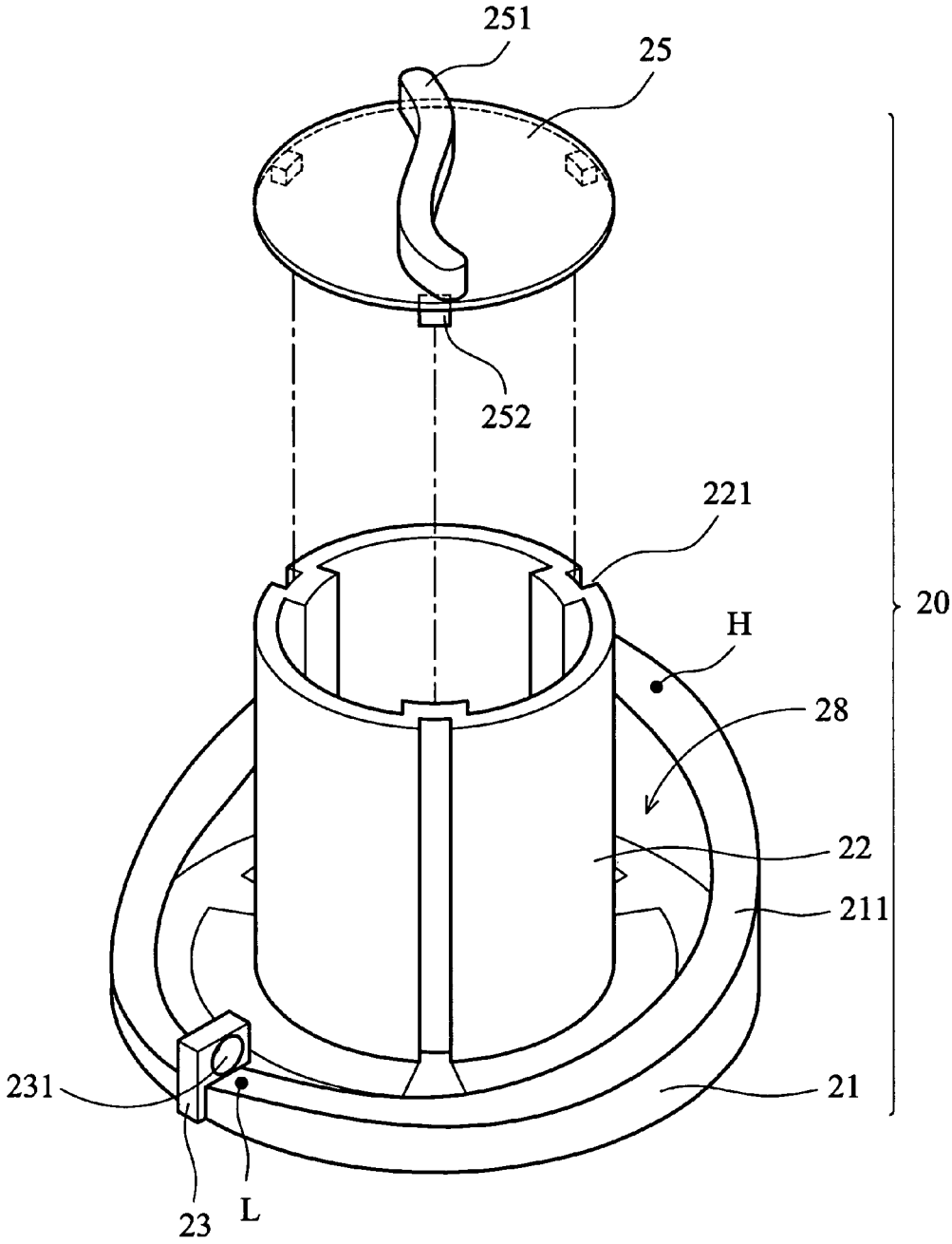
FIG. 2 is a schematic view of a line-arranging mechanism of the invention.
Figure 3:
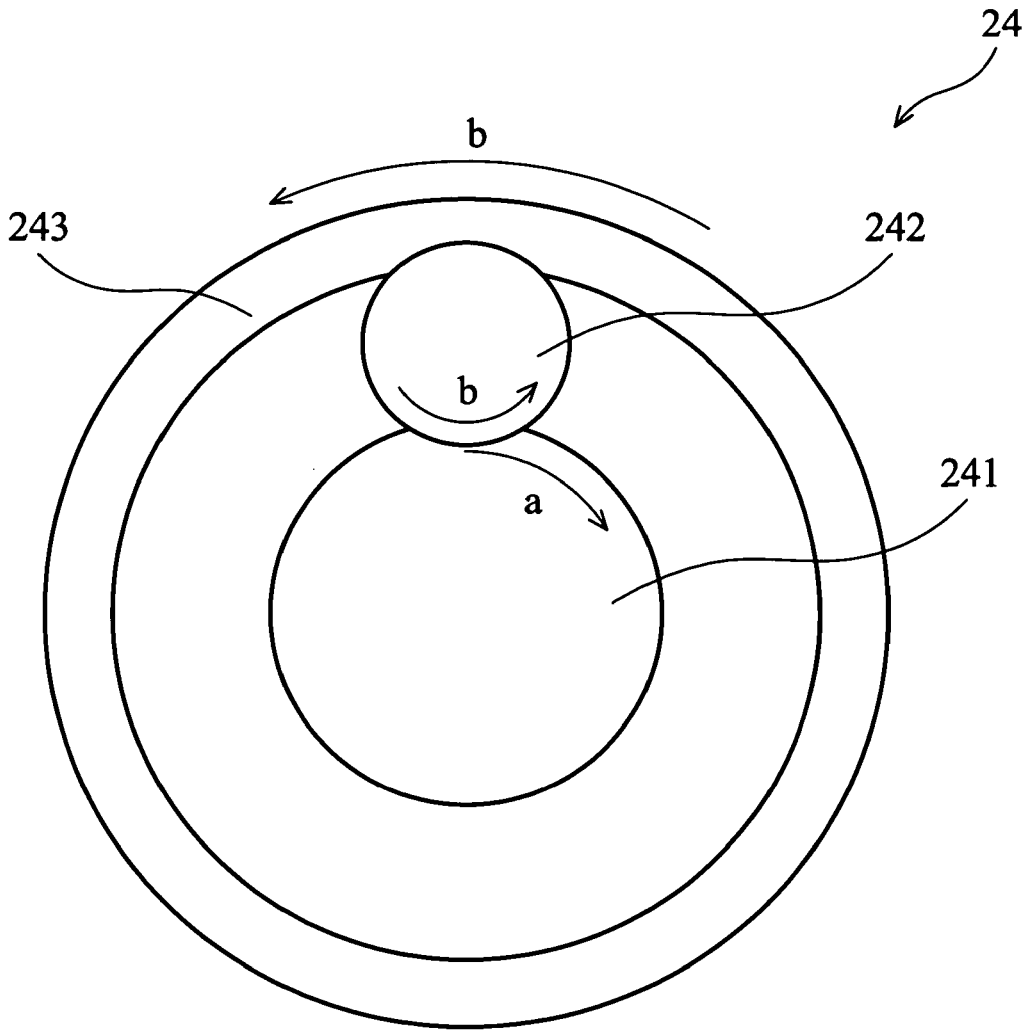
FIG. 3 is a schematic view of a transmitting mechanism of the invention.

Referring to FIGS. 2 and 3, a line-arranging mechanism 20 comprises a knob 25, a cam 21, an axle 22, a sliding element 23 and a transmitting mechanism 24 (shown by FIG. 3). The knob 25 comprises a protrusion 251 and a first engaging portion 252. A force is exerted on the protrusion 251 for rotating the axle 22. The axle 22 comprises a second engaging portion 221 which is connected to the first engaging portion 252, thereby, the knob 25 and the axle 22 rotate together for arranging the line. In this embodiment, the cam 21 is cannular and comprises an inclined surface 211 located in the rim of the cam 21. The axle is installed in the cam 21. In this embodiment, the axle 22 is approximately at the center of the cam 21. A space 28 between the axle 22 and the cam 21 contains the line (not shown). The sliding element 23 is movably installed on the inclined surface 211 and comprises a hole 231 through which the line passes. The transmitting mechanism 24 is installed at the bottom of the line-arranging mechanism 20 and connects to the cam 21 and the axle 22.

The transmitting mechanism 24 is a planetary gear system which comprises a sun gear 241, a planet pinion 242 and a ring gear 243. The sun gear 241 is connected to the axle 22. The planet pinion 242 engages the sun gear 241 and the ring gear 243. The ring gear 243 is connected to the cam 21. The transmission ratio of the sun gear 241 and the ring gear 243 ranges from 3/1 to 20/1. In this embodiment, the transmission ratio of the sun gear 241 and the ring gear 243 is 8/1. When the sun gear 241 turns eight revolutions, the ring gear 243 turns one revolution. When the axle 22 turns eight revolutions, the cam 21 turns a revolution. The inclined surface 211 comprises a high point H and a low point L. When the cam 21 turns one-second revolution (the axle 22 turns four revolutions), the sliding element 23 arrives the high point H. When the cam 21 turns another one-second revolution, the sliding element 23 returns the low point L again.

Figure 4A:
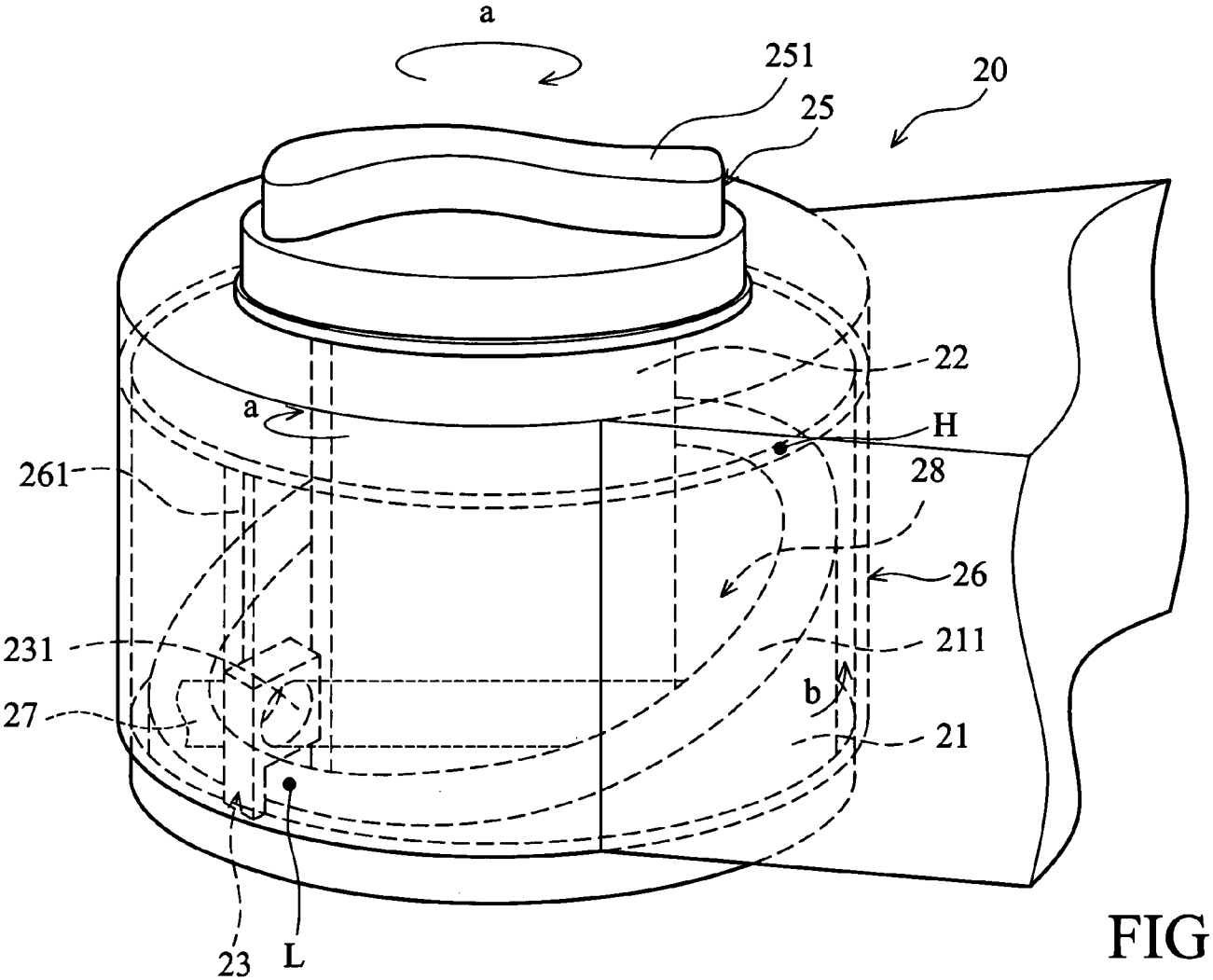
FIGS. 4A to 4C are schematic views showing a transmitting mechanism of the invention to arrange a line.

FIGS. 3 and 4A to 4C are schematic views showing a transmitting mechanism of the invention to arrange a line. Referring to FIG. 4A, the line-arranging mechanism 20 further comprises a shell 26 for covering the cam 21, the axle 22, the sliding element 23 and the transmitting mechanism 24. The line (not shown) enters the cam 21 from the shell 26. The shell 26 comprises a groove 261 on the side of the shell. The sliding element 23 is installed on the inclined surface 211 and moves at an incline along the groove 261.

Referring to FIGS. 3 and 4A, the power line 27 enters the line-arranging mechanism 20 and then passes through the hole 231. The power line 27 is arranged by the user to turn the protrusion 251 of the knob 25 along an arrow a. The knob 25 links the axle 22 to rotate the axle 22. The axle 22 links the sun gear 241 of the transmitting mechanism 24 to rotate the sun gear 241 along the arrow a. The sun gear 241 links the planet pinion 242 to rotate the ring gear 243 along an arrow b, thus the cam rotates along the arrow b.

Figure 4B:
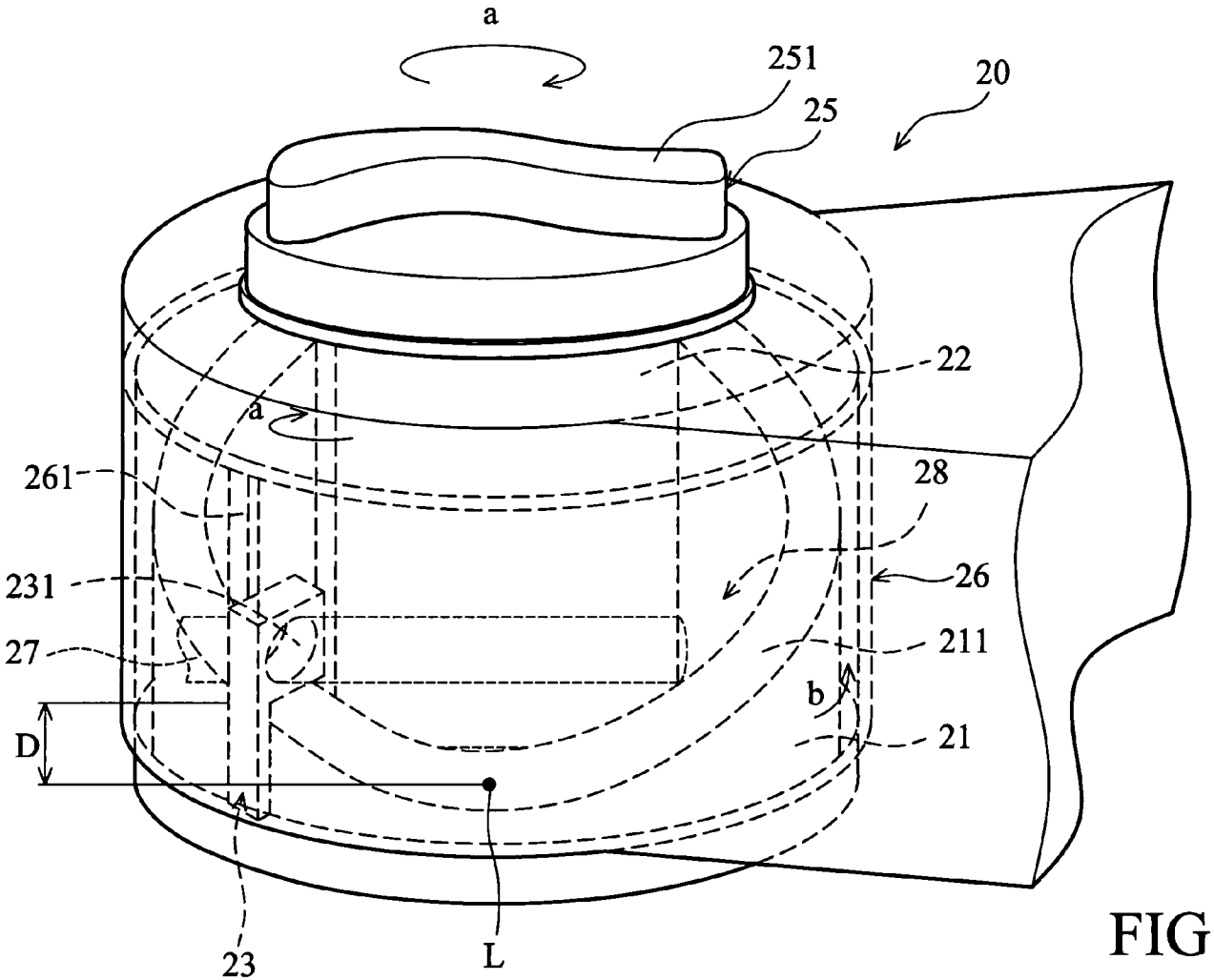
Figure 4C:
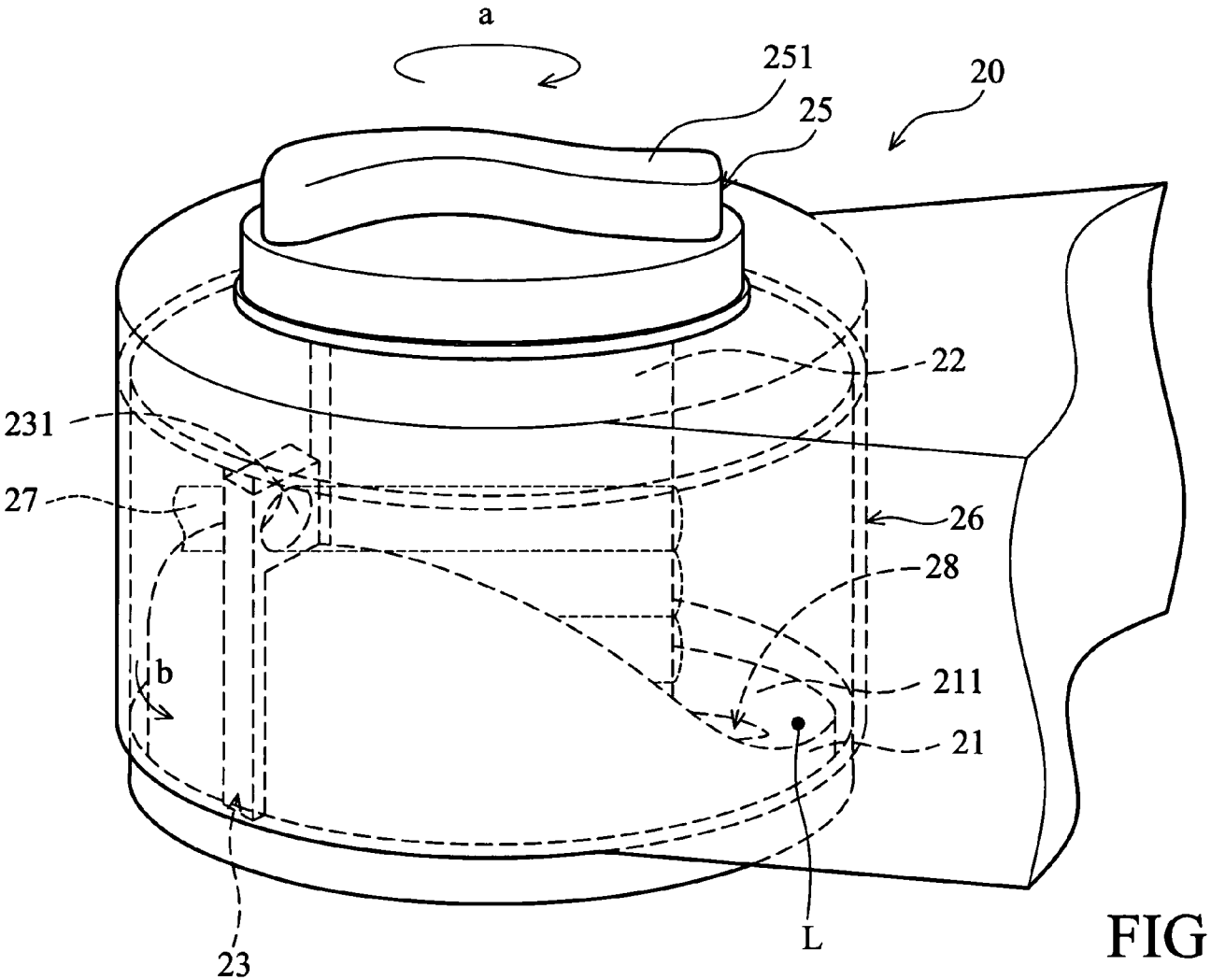

Referring to FIG. 4B, when the knob 25 rotates a revolution along the arrow a, the cam 21 rotates one-eighth revolution. The sliding element 23 in the grove 261 is pushed upward along the inclined surface 211 by rotating the cam 21. In this embodiment, when the knob 25 rotates a revolution (the cam 21 rotates one-eighth of a revolution), the sliding element 23 rises a height H equal to a diameter of the power line 27. Referring to FIG. 4C, when the knob 25 rotates four revolutions, the cam rotates one-second revolution, thus, the sliding element 23 moves at the high point H and the power line 27 is wound four revolutions on the axle 22. When the knob 25 proceeds to rotate four revolutions, the knob 25 moves downward along the inclined surface 211. The power line 27 is arranged to cover the last wound power line 27 in order. The power line 27 is wound four revolutions per a layer on the axle 22. The space 28 contains the wound power line 27.

The invention arranges the power line 27 in order without a complex mechanism, for example, a motor, a lead screw, and a bearing.

While the invention has been described by way of example and in terms of the preferred embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A line-arranging mechanism for arranging a line, comprising:

a cam comprising an inclined surface;

an axle on the cam;

a sliding element to slide on the inclined surface and comprising a hole through which the line passes; and a transmitting mechanism between the cam and the axle for rotating simultaneously the cam and the axle.

2. The line-arranging mechanism as claimed in claim 1, wherein the transmitting mechanism comprises a planetary gear system to drive the cam and the axle.

3. The line-arranging mechanism as claimed in claim 2, wherein the planetary gear system comprises a sun gear, a planet pinion and a ring gear; the sun gear is connected to the axle; the planet pinion engages with the sun gear and the ring gear; the ring gear is connected to the cam.

4. The line-arranging mechanism as claimed in claim 3, wherein the transmission ratio of the sun gear and the ring gear ranges from 3/1 to 20/1.

5. The line-arranging mechanism as claimed in claim 1, wherein the sliding element moves upward or downward along the inclined surface.

6. The line-arranging mechanism as claimed in claim 1, further comprising a knob connected to the axle.

7. The line-arranging mechanism as claimed in claim 6, wherein the knob comprises a protrusion and a first engaging portion; the axle comprises a second engaging portion; the first engaging portion is connected to the second engaging portion; when a force is exerted at the protrusion, the axle connected to the protrusion rotates.

8. The line-arranging mechanism as claimed in claim 1, wherein when the cam rotates each turn, the sliding element vertically moves a height equal to the diameter of the line.

9. The line-arranging mechanism as claimed in claim 1, further comprising a space between the cam and the line-arranging mechanism for containing the line.

10. The line-arranging mechanism as claimed in claim 1, further comprising a shell for covering the cam.

11. A line-arranging mechanism for arranging a line, comprising:

a cam comprising an inclined surface;

an axle on the cam;

a sliding element to slide on the inclined surface;

a transmitting mechanism between the cam and the axle for rotating simultaneously the cam and the axle; and a shell, comprising a groove parallel to the axle and installed on the shell;

wherein the sliding element is movably installed in the groove.

* * * * *